US010081179B2

(12) United States Patent
Tozuka

(10) Patent No.: US 10,081,179 B2
(45) Date of Patent: Sep. 25, 2018

(54) INKJET HEAD AND METHOD FOR MANUFACTURING INKJET HEAD

(71) Applicant: TOSHIBA TEC KABUSHIKI KAISHA, Tokyo (JP)

(72) Inventor: Takashi Tozuka, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/694,928

(22) Filed: Sep. 4, 2017

(65) Prior Publication Data

US 2018/0086072 A1 Mar. 29, 2018

(30) Foreign Application Priority Data

Sep. 23, 2016 (JP) ..... 2016-185119

(51) Int. Cl.

| | |
|---|---|
| ***B41J 2/045*** | (2006.01) |
| ***B41J 2/14*** | (2006.01) |
| ***B41J 2/03*** | (2006.01) |
| *B41J 2/175* | (2006.01) |

(52) U.S. Cl.

CPC ..... *B41J 2/14201* (2013.01); *B41J 2/03* (2013.01); *B41J 2/14032* (2013.01); *B41J 2/175* (2013.01); *B41J 2002/14241* (2013.01); *B41J 2202/22* (2013.01)

(58) Field of Classification Search

CPC ..... B41J 2/14201; B41J 2/14032; B41J 2/03
USPC ..... 347/68, 70–72
See application file for complete search history.

(56) References Cited

U.S. PATENT DOCUMENTS 7,290,868 B2 * 11/2007 Sakamoto ..... B41J 2/1609 347/40
8,419,172 B2 * 4/2013 Koseki ..... B41J 2/14209 347/68
8,944,565 B2 * 2/2015 Gao ..... B41J 2/14233 347/50

FOREIGN PATENT DOCUMENTS

JP 2015-051569 3/2015

* cited by examiner

*Primary Examiner* — An Do
(74) *Attorney, Agent, or Firm* — Patterson & Sheridan, LLP

(57) ABSTRACT

According to one embodiment, a method for manufacturing an inkjet head includes attaching a piezoelectric body facing the substrate, forming slanting side surfaces on the piezoelectric body, the slanting side surfaces extending between a first surface and a second surface of the piezoelectric body such that first surface has a remaining area that is less that a remaining area of second surface, forming a groove in the piezoelectric body from the first surface towards the second surface, the groove passing through two slanting side surfaces on opposite sides of the piezoelectric body, forming a conductive film on an inner surface of the groove, trimming portions of the conductive film proximate to the first surface and the slanting side surfaces such that the conductive film is separated from the first surface and the slanting side surfaces at outer edges of the groove, and forming an insulating film over the conductive film.

20 Claims, 8 Drawing Sheets

INKJET HEAD AND METHOD FOR MANUFACTURING INKJET HEAD

CROSS-REFERENCE TO RELATED APPLICATION

This application is based upon and claims the benefit of priority from Japanese Patent Application No. 2016-185119, filed Sep. 23, 2016, the entire contents of which are incorporated herein by reference.

FIELD

Embodiments described herein relate generally to an inkjet head, a method for manufacturing the inkjet head, and an inkjet head recording apparatus having the inkjet head mounted therein.

BACKGROUND

An inkjet printer for dispensing ink droplets on a medium, such as paper, to form images or characters is known. Inkjet printers include an inkjet head which ejects the ink droplets according to an image signal.

The inkjet head includes a nozzle from which ink droplets can be ejected, an ink pressure chamber communicating with the nozzle, and an actuator which generates pressure for causing ink to be ejected from the nozzle. The actuator includes a piezoelectric body. A piezoelectric element, also referred to as a piezo element, included in the piezoelectric body, is an electromechanical conversion element to convert a voltage into force. The deformation of the piezoelectric element is used to generate pressure in ink contained in the ink pressure chamber. The pressure generated in ink causes ink to be ejected from the nozzle. A typical material of the piezoelectric element includes piezoelectric lead zirconate titanate (PZT).

An inkjet head which operates using shear deformation of a piezoelectric body is known. This type of an inkjet head includes a piezoelectric body having a groove serving as an ink flow path formed thereon, an electrode formed on an inner surface of the groove, a nozzle plate having nozzles formed therein to eject ink, and a protective film covering the electrode. The nozzle plate is bonded to the upper surface of the piezoelectric body in such a manner that each nozzle corresponds to a groove formed on the piezoelectric body. The electrode is formed not to extend to the upper surface of the piezoelectric body. The electrode not extending to the upper surface of the piezoelectric body prevents or reduces the deformation of the nozzle plate bonded to the piezoelectric body.

In the inkjet head configured as described above, the protective film covering the electrode is considered insufficient in insulating property.

DETAILED DESCRIPTION

Figure 1:
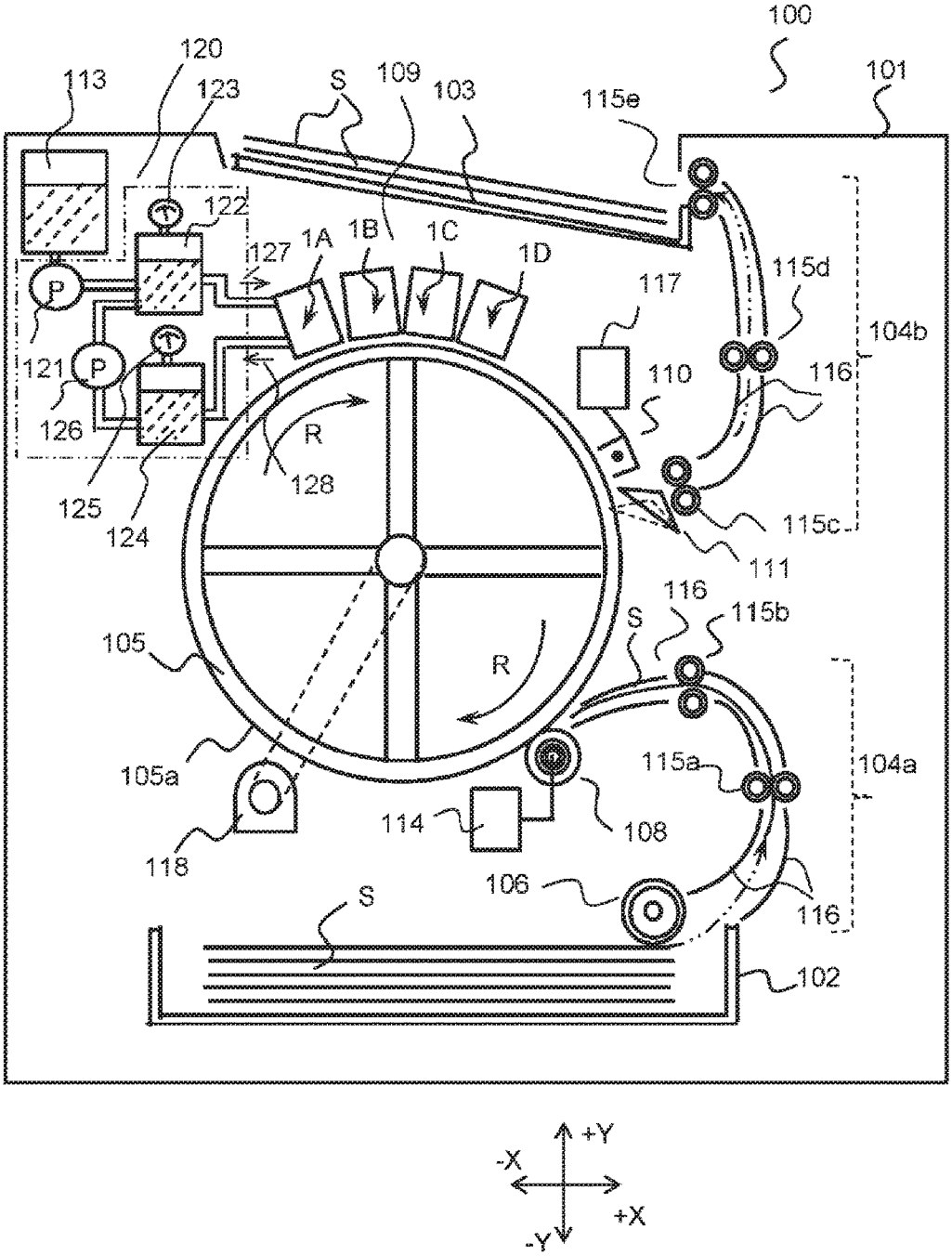
FIG. 1 is a schematic side view of an inkjet printer according to a first embodiment.

In general, according to one embodiment, a method for manufacturing an inkjet head includes attaching a piezoelectric body having a first surface and a second surface opposite to the first surface to a substrate, the second surface facing the substrate, forming slanting side surfaces on the piezoelectric body, the slanting side surfaces extending between the first surface and the second surface such that first surface has a remaining area that is less that a remaining area of second surface, forming a groove in the piezoelectric body from the first surface towards the second surface, the groove passing through two slanting side surfaces on opposite sides of the piezoelectric body, forming a conductive film on an inner surface of the groove, trimming portions of the conductive film proximate to the first surface and the slanting side surfaces such that the conductive film is separated from the first surface and the slanting side surfaces at outer edges of the groove, and forming an insulating film over the conductive film.

Hereinafter, various example embodiments will be described with reference to the drawings. The respective same reference numerals in the drawings denote the respective same members or portions.

In a typical inkjet head, the insulation property of an electrode protective film formed in an ink flow path may sometimes decrease at the end portion of a piezoelectric body, as the protective film becomes thinner towards the end portion of the piezoelectric body. In an inkjet head for ejecting aqueous ink, the electrode is required to be electrically insulated with a protective film so as to prevent the electrode from contacting ink. If the insulation property of the protective film decreases, an electric field which applied to the piezoelectric body causes electrolysis in ink. To prevent the electrolysis of ink, sufficient insulation of the electrode at the end portion of the piezoelectric body is required.

A recording medium S is, for example, plain paper, art paper, or coated paper. Ink is a liquid in which a dye or a pigment, serving as colorant, is dissolved or dispersed in a solvent. Examples of the ink solvent include water, aqueous solvents, non-aqueous solvents, oil-based solvent, and mixed solvents.

First Embodiment

FIG. 1 illustrates a cross-section of an inkjet printer 100 which is equipped with inkjet heads, 1A, 1B, 1C, and 1D, according to the first embodiment. The inkjet heads 1A to 1D (a printing unit 109) eject cyan ink, magenta ink, yellow ink, and black ink, respectively, to record an image on a recording medium S (e.g., sheet of paper) according to an image signal input from outside the inkjet printer 100.

The inkjet printer 100 includes a box-shaped chassis 101. A sheet feed cassette 102, an upstream conveyance path 104*a*, a holding drum 105, a printing unit 109, a downstream conveyance path 104*b*, and a sheet discharge tray 103 are arranged from the lower portion to the upper portion in the Y-axis direction inside the chassis 101. The sheet feed cassette 102 contains sheets S to be used for printing by the inkjet printer 100. The printing unit 109 includes four inkjet heads, i.e., a cyan inkjet head 1A, a magenta inkjet head 1B, a yellow inkjet head 1C, and a black inkjet head 1D. The inkjet heads 1A to 1D are portions which eject ink droplets to the sheet S held on the holding drum 105 to record an image.

The sheet feed cassette 102, which contains sheets S, is provided at the lower portion of the chassis 101. A sheet feed roller 106 sends sheets S on one sheet at a time from the sheet feed cassette 102 to the upstream conveyance path 104*a*. The upstream conveyance path 104*a* includes sending roller pairs 115*a* and 115*b* and sheet guide plates 116, which regulate the conveyance direction of the sheet S. The sheet S is conveyed by the rotation of the sending roller pairs 115*a* and 115*b*, and, after passing through the sending roller pair 115*b*, is sent to the outer circumferential surface of the holding drum 105 along the sheet guide plates 116. The dashed-line arrows in FIG. 1 indicate a guided pathway of the sheet S.

The holding drum 105 is a cylinder made of aluminum having a thin insulating layer 105*a* of resin on the surface thereof. The circumferential length of the cylinder is longer than a length of a sheet S on which an image is to be recorded, and the length in the axial direction of the cylinder is longer than a width of the sheet S. The holding drum 105 is configured to be rotated by a motor 118 at a predetermined circumferential velocity in the direction of the arrow R. While the insulating layer 105*a* of the holding drum 105 holds the sheet S electrostatically, the holding drum 105 rotates to convey the sheet S to the printing unit 109. A charging roller 108, which charges the insulating layer 105*a* with static electricity, is arranged in contact with and along the insulating layer 105*a*.

The charging roller 108 has a rotating shaft made of metal and a conductive rubber layer, which is arranged around the rotating shaft. The charging roller 108 is connected to a high-voltage generation circuit 114. The surface of the conductive rubber layer is in contact with the insulating layer 105*a* of the holding drum 105, and the charging roller 108 is driven by a motor to rotate in such a manner that the circumferential velocity of the charging roller 108 is equal to the circumferential velocity of the holding drum 105. The insulating layer 105*a* of the holding drum 105 and the conductive rubber layer of the charging roller 108 contact each other to form a nip. The sheet S is sent to the nip by the sending roller pair 115*b* and the sheet guide plates 116. A high voltage generated by the high-voltage generation circuit 114 is applied to the metal rotating shaft of the charging roller 108 immediately before the sheet S is conveyed to the nip. The insulating layer 105*a* is electrically charged by the high voltage, and the sheet S conveyed to the nip is also electrically charged and is then electrostatically attracted to the outer circumferential surface of the holding drum 105. The electrostatically-attracted sheet S is sent to the printing unit 109 by the rotation of the holding drum 105.

The printing unit 109 is fixed to the inkjet printer 100 with the ink ejection surfaces of the inkjet heads 1A to 1D and separated from the outer circumferential surface of the holding drum 105 by 1 mm. Each of the inkjet heads 1A to 1D, which are arranged at intervals in the circumferential direction of the holding drum 105, is long in the axial direction of the holding drum 105, referred to as a main scanning direction, and short in the rotational direction of the holding drum 105, referred to as a sub scanning direction. Each of the inkjet heads 1A to 1D ejects part of the supplied ink for image formation from the nozzle, and discharges the remaining ink to outside of the inkjet head. The discharged ink is collected and is then re-supplied to the inkjet head. This is what is referred to as a circulation type inkjet head. The detailed structure of each of the inkjet heads 1A to 1D is described below. An ink tank 113 is an ink container which reserves cyan ink, referred to simply as ink. An ink circulation device 120 is arranged between the ink tank 113 and the ink jet head 1A.

The ink circulation device 120 includes an ink supply pump 121, a supplying ink tank 122, a first pressure regulation unit 123, a collecting ink tank 124, a second pressure regulation unit 125, and an ink collection pump 126. The ink is ejected from the inkjet head 1A according to an image signal. The ink supply pump 121 supplies ink corresponding to the amount of ejected ink from the ink tank 113 to the supplying ink tank 122. The supplying ink tank 122 reserves the ink and then supplies the ink to the inkjet head 1A through a flow path 127. The supplying ink tank 122 is provided with the first pressure regulation unit 123. The collecting ink tank 124 reserves ink discharged from the inkjet head 1A through a flow path 128. The collecting ink tank 124 is provided with the second pressure regulation unit 125. The ink collection pump 126 sends the ink reserved in the collecting ink tank 124 to the supplying ink tank 122. The inkjet head 1A ejects an ink droplet in the direction of the gravitational force parallel to the direction −Y. Therefore, to prevent ink from leaking from the inkjet head 1A during a waiting time, it is necessary to keep the inside of each nozzle of the inkjet head 1A at negative pressure with respect to the atmospheric pressure. The first pressure regulation unit 123 and the second pressure regulation unit 125 regulate the ink pressure to negative pressure with respect to the atmospheric pressure in such a manner that the ink supplied to the inkjet head 1A does not leak from each nozzle of the inkjet head 1A. The pressure of ink in the nozzle is set lower by 1 kPa than the atmospheric pressure. Each of the inkjet heads 1B to 1D also includes a similar ink tank 113 and a similar ink circulation device 120. In FIG. 1, the ink tanks 113 and the ink circulation devices 120 for each of the inkjet heads 1B to 1D are omitted from illustration.

In the printing unit 109, the inkjet heads 1A to 1D eject ink on the sheet S to form an image. An image is recorded according to an image signal input from outside the inkjet printer 100. The inkjet head 1A ejects cyan ink to forma cyan image. Similarly, the inkjet head 1B ejects magenta ink, the inkjet head 1C ejects yellow ink, and the inkjet head 1D ejects black ink, thus forming the respective color images. The inkjet heads 1A to 1D have the same configuration except for colors of ink to be ejected.

The sheet S on which an image has been recorded by the printing unit 109 is conveyed to a destaticizing device 110 (which is, e.g., an electrostatic discharge device) and a separating claw 111. The destaticizing device 110 has a U-shaped cross section, and made of a tungsten wire extending in a stainless chassis the length of which is the same as the length in the axial direction of the holding drum 105. The destaticizing device 110 is located in such a manner that the opening of the U-shaped chassis faces the outer circumferential surface of the holding drum 105. A high-voltage generation circuit 117 generates a high voltage opposite in polarity to the voltage applied to the charging roller 108. When the leading end of the sheet S with recording completed arrives at below the destaticizing device 110 in the process of being conveyed, the high voltage generated by the high-voltage generation circuit 117 is applied between the chassis and the tungsten wire. Corona discharge occurs from the opening side of the destaticizing device 110 due to the high voltage, thus destaticizing the electrically-charged sheet S. The separating claw 111 is provided as to move between a contact position at which the claw tip is in contact with the outer circumferential surface of the holding drum 105 and a separation position in which the claw tip is away from the outer circumferential surface thereof. Typically, the separating claw 111 is held at the separation position. To separate the sheet S from the holding drum 105, the tip of the separating claw 111 contacts the outer circumferential surface of the holding drum 105 and then separates the leading end of the destaticized sheet S from the insulating layer 105*a*. After separating the leading end of the sheet S from the outer circumferential surface, the separating claw 111 is returned from the outer circumferential surface to the separation position.

The sheet S separated from the holding drum 105 is sent to a sending roller pair 115*c*. The downstream conveyance path 104*b* includes sending roller pairs 115*c*, 115*d*, and 115*e* and sheet guide plates 116, which regulate the conveyance direction of the sheet S. The sheet S is conveyed by the sending roller pairs 115*c*, 115*d*, and 115*e* along the dashed-line arrow illustrated in FIG. 1 and is thus discharged to the sheet discharge tray 103.

A configuration of the inkjet head 1A is described in detail. As described above, the inkjet heads 1B to 1D each have the same structure as that of the inkjet head 1A.

Figure 2A:
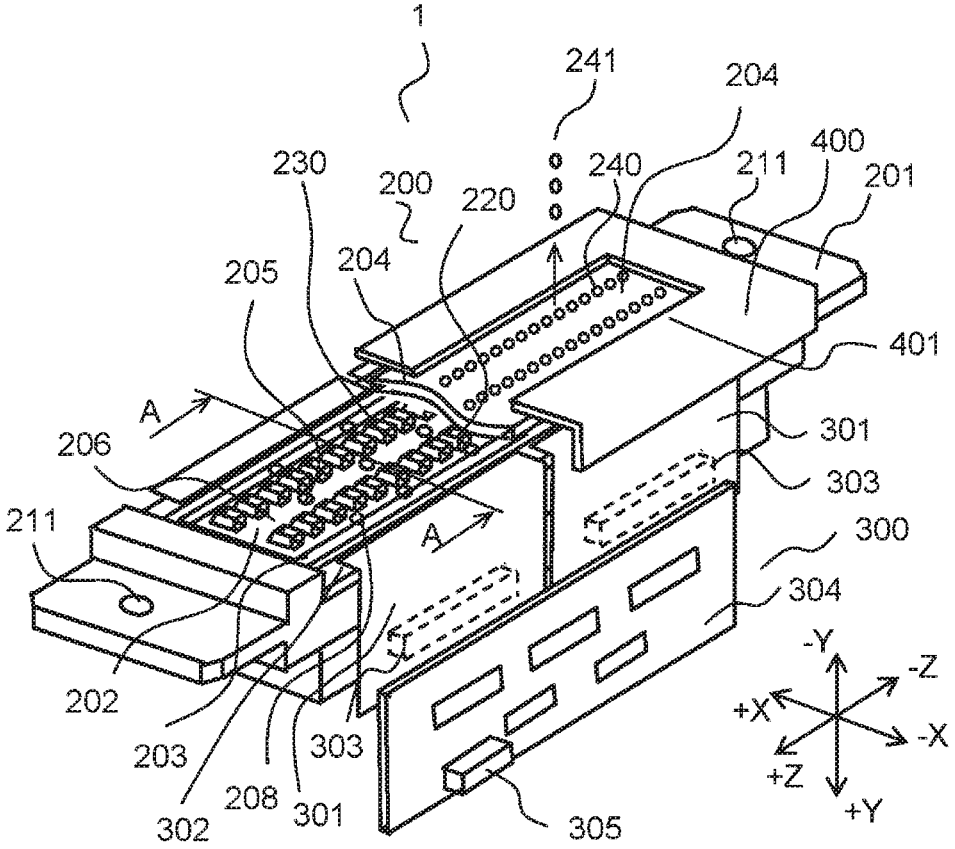
FIG. 2A is a perspective view of an outer appearance of an inkjet head according to the first embodiment.
Figure 2B:
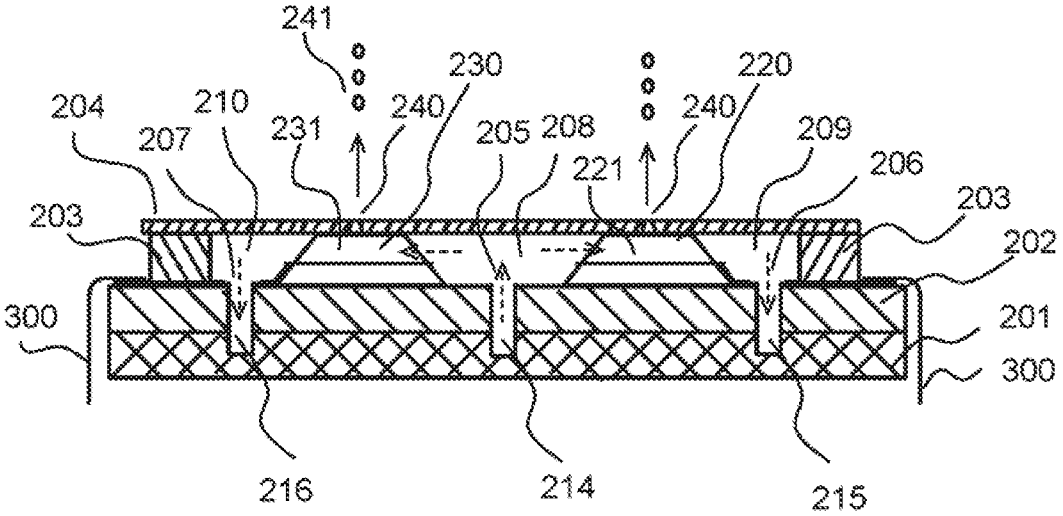
FIG. 2B is a cross-sectional view taken along line A-A in FIG. 2A.
Figure 3:
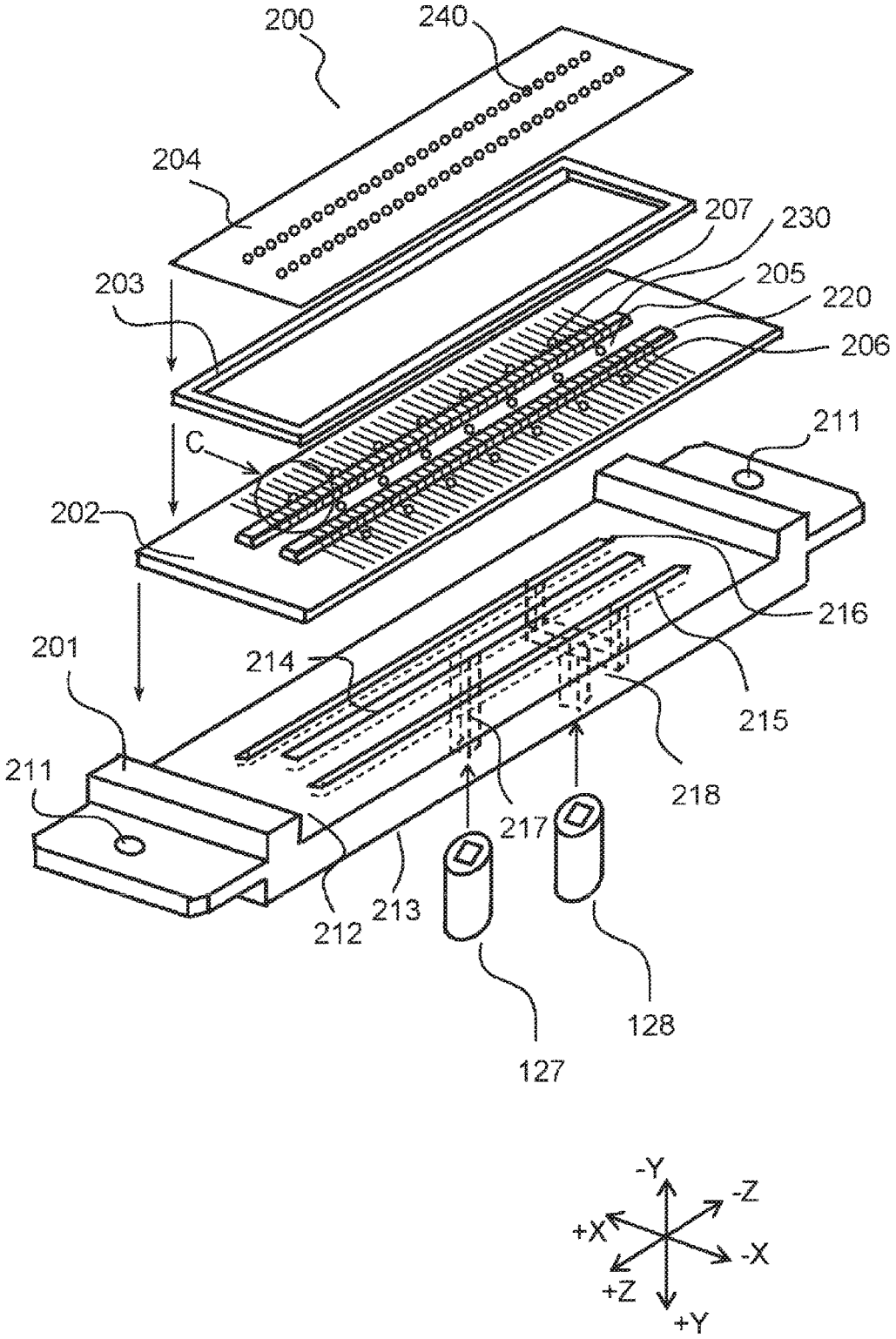
FIG. 3 is an exploded perspective view of an inkjet head according to the first embodiment.
Figure 4:
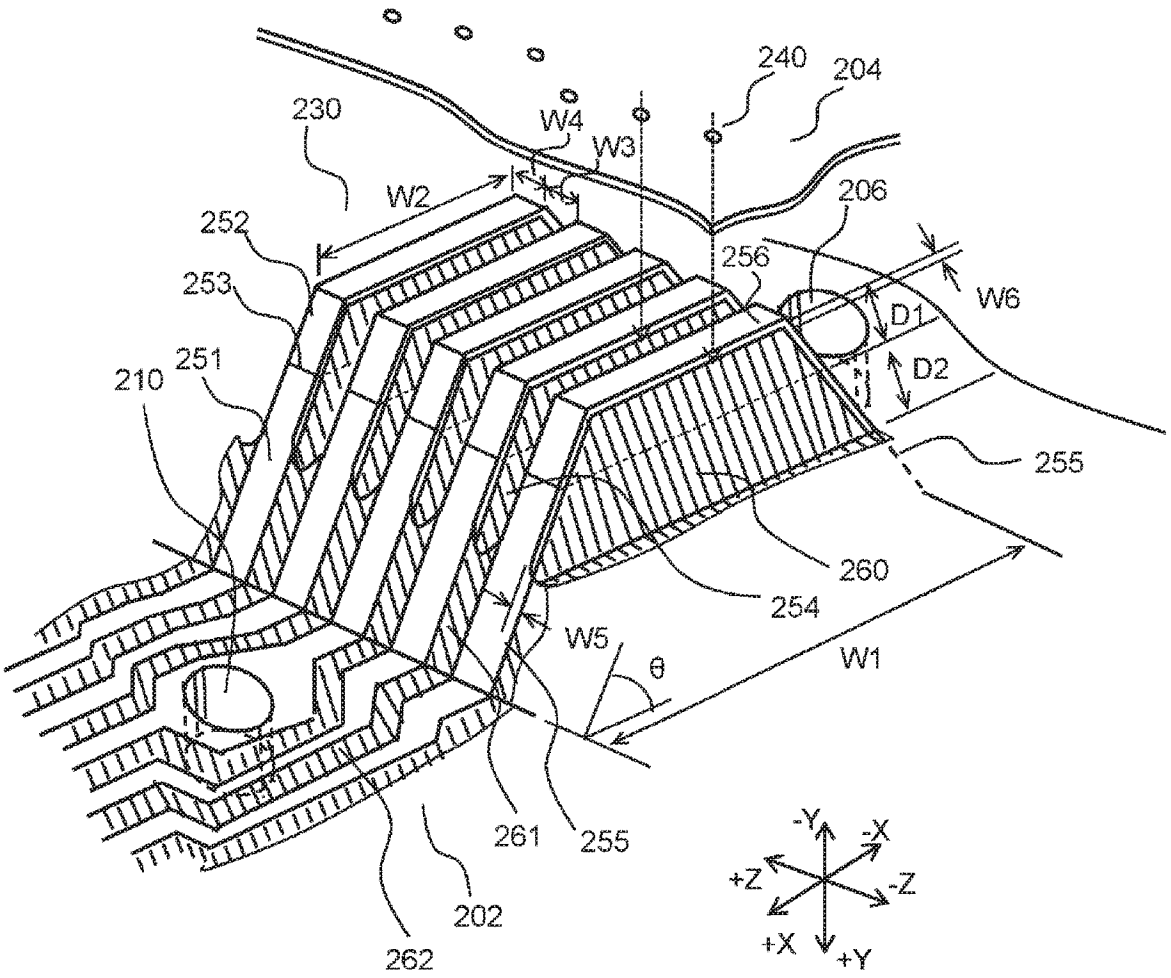
FIG. 4 is a diagram of a piezoelectric actuator of an inkjet head according to the first embodiment.

FIG. 2A is an external perspective view of an inkjet head 1. Furthermore, FIG. 2B is a cross-sectional view taken along line A-A in FIG. 2A. FIG. 3 is an exploded perspective view of the inkjet head 1. FIG. 4 is an enlarged view of a region C illustrated in FIG. 3.

The inkjet head 1 illustrated in FIG. 2A includes an ink ejection portion 200, a circuit module 300, and a cover 400. Apart of the external perspective view of FIG. 2A illustrates an internal structure of the ink ejection portion 200. The ink ejection portion 200 includes a manifold 201, a substrate 202, a frame 203, and a nozzle plate 204.

The nozzle plate 204 has a plurality of nozzles 240 through which to eject ink droplets 241. The nozzle plate 204 is made from a polyimide resin. The outer shape of the nozzle plate 204 has a width of 16 mm in the X-axis direction, a length of 60 mm in the Z-axis direction, and a thickness of 50 μm in the Y-axis direction. The nozzles 240 with a diameter of 20 μm are arranged at pitches of 85 μm in two lines.

The frame 203 is made of stainless steel. The outer shape of the frame 203 has a length of 60 mm, a width of 16 mm, and a thickness of 1 mm. An opening with a length of 56 mm and a width of 12 mm is formed on the inner side of the frame 203. Thus, the frame 203 with a width of 2 mm is formed. The frame 203 is sandwiched between the substrate 202 and the nozzle plate 204 and serves to prevent ink from leaking to the outside.

The cover 400 is provided to protect the nozzle plate 204, the ink ejection portion 200, the manifold 201, and the circuit module 300. The cover 400 is made of a stainless steel with a thickness of 0.1 mm. The cover 400 has an opening 401 through which a region having the nozzles 240 formed therein is exposed. Ink droplets 241 are ejected through the opening 401.

The substrate 202 is made from alumina ($Al_2O_3$). The outer shape of the substrate 202 has a width of 20 mm, a length of 60 mm, and a thickness of 1 mm.

The substrate 202 has ink supply ports 205, first ink discharge ports 206, and second ink discharge ports 207. A first piezoelectric actuator row 220 and a second piezoelectric actuator row 230 are each aligned in a line on the substrate 202. The frame 203 is fixed onto the substrate 202 so as to surround the first and second piezoelectric actuator rows 220 and 230. The nozzle plate 204 is fixed by epoxy bonding agent to the frame 203 and the top portions of the first and second piezoelectric actuator rows 220 and 230.

A plurality of ink supply ports 205 is arranged in a row between the first piezoelectric actuator row 220 and the second piezoelectric actuator row 230. A region surrounded by the substrate 202, the first and second piezoelectric actuator rows 220 and 230, and the nozzle plate 204 serves as a common ink supply chamber 208. The ink supply ports 205 supply ink from the manifold 201 to the common ink supply chamber 208. The common ink supply chamber 208 supplies ink to a plurality of pressure chambers 221 formed in the first piezoelectric actuator row 220 and a plurality of pressure chambers 231 formed in the second piezoelectric actuator row 230. The nozzle 240 is located at the central portion of each of the pressure chambers 221 and 231.

The plurality of first ink discharge ports 206 is arranged in a row in the longitudinal direction parallel to the Z-axis direction between the first piezoelectric actuator row 220 and the frame 203. A region surrounded by the first piezoelectric actuator row 220, the frame 203, and the nozzle plate 204 serves as a first common ink discharge chamber 209. The ink discharged through the plurality of pressure chambers 221 is sent to the manifold 201 through the first common ink discharge chamber 209 and the first ink discharge ports 206. The plurality of second ink discharge ports 207 is arranged in a row between the second piezoelectric actuator row 230 and the frame 203. A region surrounded by the second piezoelectric actuator row 230, the frame 203, and the nozzle plate 204 serves as a second common ink discharge chamber 210. The ink discharged through the plurality of pressure chambers 231 is sent to the manifold 201 through the second common ink discharge chamber 210 and the second ink discharge ports 207. Ink is supplied from the ink supply ports 205 through the common ink supply chamber 208, the pressure chambers 221, the first common ink discharge chamber 209, and the first ink discharge ports 206 to the manifold 201, as indicated by the dashed-line arrow. Similarly, ink is supplied from the ink supply ports 205 through the common ink supply chamber 208, the pressure chambers 231, the second common ink discharge chamber 210, and the second ink discharge ports 207 to the manifold 201, as indicated by the dashed-line arrow.

As illustrated in FIG. 3, the manifold 201 has an upper surface 212, onto which the substrate 202 is fixed, and a lower surface 213, which is opposite to the upper surface 212. The upper surface 212, onto which the substrate 202 is fixed, has a width of 20 mm in the X-axis direction and a length of 60 mm in the Z-axis direction. The manifold 201 is made from aluminum. The upper surface 212 has three long slots 214, 215, and 216 formed therein in the Z-axis direction. The long slot 214 communicates with the plurality of ink supply ports 205 and also communicates with an ink supply tube 217, which penetrates through the manifold 201. The ink supply tube 217 is connected to the flow path 127, which communicates with the ink circulation device 120. The long slot 215 communicates with the plurality of first ink discharge ports 206. The long slot 216 communicates with the plurality of second ink discharge ports 207. The long slots 215 and 216 communicate with an ink discharge tube 218, which penetrates through the manifold 201. The ink discharge tube 218 is connected to the flow path 128, which communicates with the ink circulation device 120. The manifold 201 has openings 211 formed at both end portions thereof in the longitudinal direction. The inkjet head 1 is screwed to the inkjet printer 100 via the openings 211.

As illustrated in FIG. 3, the substrate 202, the frame 203, and the nozzle plate 204 are stacked and bonded onto the manifold 201 by epoxy bonding agent. The frame 203 is fixed to the substrate 202 so as to surround the first piezoelectric actuator row 220 and the second piezoelectric actuator row 230.

Configurations of the first piezoelectric actuator row 220 and the second piezoelectric actuator row 230 are described. The first and second piezoelectric actuator rows 220 and 230 have the same configuration. FIG. 4 is an enlarged view of a region C surrounded by a circle illustrated in FIG. 3.

The second piezoelectric actuator row 230 is formed as a stacked piezoelectric body 251 and 252 configured with a first piezoelectric body 251 and a second piezoelectric body 252. The first piezoelectric body 251 and the second piezoelectric body 252 are made from piezoelectric zirconate titanate (PZT). The first piezoelectric body 251 has a width of 3.5 mm, a length of 52 mm, and a thickness of 0.9 mm, and is polarized in the −Y direction. The second piezoelectric body 252 has a width of 3.5 mm, a length of 52 mm, and a thickness of 0.1 mm, and is polarized in the +Y direction. The directions of polarization of the first piezoelectric body 251 and the second piezoelectric body 252 are opposite to each other. The first piezoelectric body 251 and the second piezoelectric body 252 are bonded to each other by epoxy bonding agent 253 and have a total thickness of 1 mm. The stacked piezoelectric body 251 and 252 has slant surfaces 255 with an angle θ of 45 degrees formed at both ends thereof along the X-axis direction. The slant surface 255 extends from one side on the side of the substrate 202 to the other side on the side of the nozzle plate 204 along the Z-axis direction. The width W1 of the stacked piezoelectric body 251 and 252 on the side of the substrate 202 is 3.5 mm and the width W2 thereof on the side of the nozzle plate 204 is 1.5 mm.

The stacked piezoelectric body 251 and 252 has a plurality of grooves 254 formed therein so as to traverse the slant surfaces 255 in the X-axis direction. The width W3 of the groove 254 is 0.04 mm. The grooves 254 are arranged with pitches of 0.085 mm at regular intervals in the Z-axis direction. The width W4 of the stacked piezoelectric body (251 and 252) is 0.045 mm. The depth of the groove 254 is 0.2 mm. The depth D2 of a portion of the groove 254 corresponding to the first piezoelectric body 251 is 0.1 mm, and the depth D1 of a portion of the groove 254 corresponding to the second piezoelectric body 252 is 0.1 mm.

An electrode film 260, made of a conductive film, with a thickness of 2 μm is formed on the inner surface of the groove 254. The electrode film 260 is a plating film of nickel (Ni) and gold (Au). The electrode film 260 is formed by an electroless plating process. The electrode film 260 formed on the inner surface of the groove 254 is separated from a side edge of the upper surface 256 of the stacked piezoelectric body 251 and 252 by a distance W6 and is separated from a side edge of the slant surface 255 by a distance W5. The electrode film 260 is formed on a portion of the inner surface of the groove 254 excluding portions corresponding to edge portions of the stacked piezoelectric body 251 and 252. The stacked piezoelectric body 251 and 252 with the electrode film 260 formed in the groove 254 functions as a piezoelectric actuator. Each of the first and second piezoelectric actuator rows 220 and 230 has a plurality of such piezoelectric actuators arranged in a row. The electrode film 260 formed in the groove 254 is connected to a first extraction electrode 261 formed on the slant surface 255 and to a second extraction electrode 262 on the substrate 202 connected to the first extraction electrode 261. The first extraction electrode 261 formed on the slant surface 255 is smoothly connected to the electrode film 260 formed in the groove 254 and the second extraction electrode 262. The second extraction electrode 262 is electrically connected to a drive circuit 301 mounted on the circuit module 300. Other materials usable for the electrode film 260 include, for example, gold (Au) and copper (Cu). It is desirable that the thickness of the plating film be in the range of 0.5 μm to 5 μm. Each of the distances W5 and W6 is set to 5 μm. It is desirable that each of the distances W5 and W6 be in the range of 1 μm to 15 μm. If the distance W5 or W6 is less than 1 μm, the electrode film 260 remains in the vicinity of a side edge, and, if the distance W5 or W6 exceeds 15 μm, the area used for applying a voltage to the stacked piezoelectric body 251 and 252 reduces. If the electrode area reduces, the amount of change in the volume of the pressure chamber reduces, so that the amount of ejection of ink decreases. Without an electrode located in the vicinity of a side edge, the electrode area of one wall surface of the stacked piezoelectric body 251 and 252 (i.e., the wall surface in the groove) is calculated to be 99% when each of the distances W5 and W6 is 1 μm, as compared with a case where an electrode is formed on the entire wall surface. When each of the distances W5 and W6 is 15 μm, the electrode area is 90% as compared with a case where an electrode is formed on the entire wall surface.

Figure 5A:
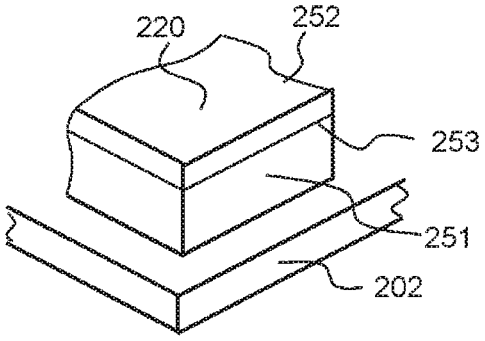
FIGS. 5A, 5B, 5C, 5D, 5E, 5F, 5G, 5H, 5I, 5J, and 5K are diagrams of a method for manufacturing an inkjet head according to the first embodiment.
Figure 5B:
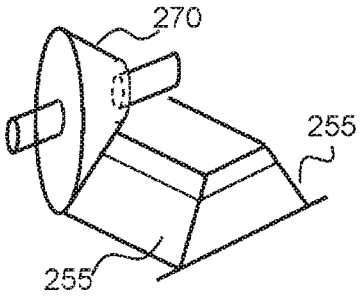
Figure 5C:
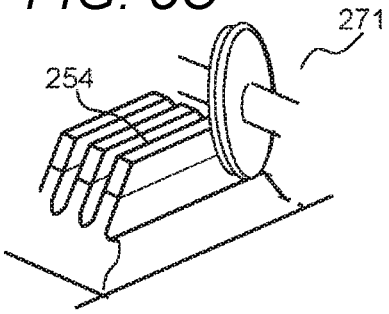
Figure 5D:
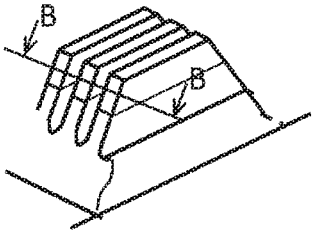
Figure 5E:
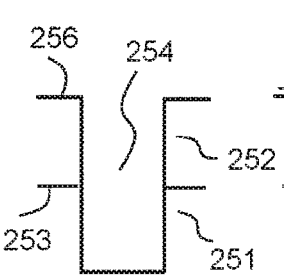
Figure 5F:
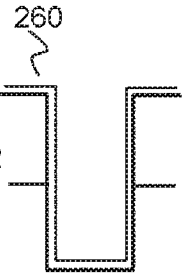
Figure 5G:
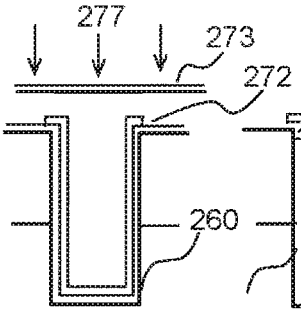
Figure 5H:
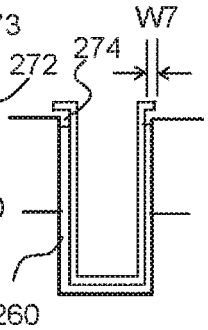
Figure 5I:
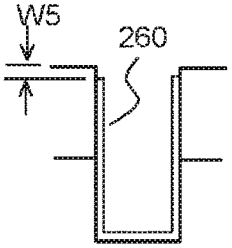
Figure 5J:
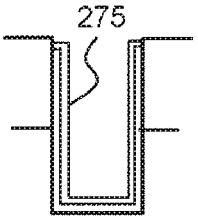

A first insulating film 275 of polyimide resin is formed on the electrode film 260 in the groove 254, the first extraction electrode 261, and the second extraction electrode 262 by an electrodeposition method as illustrated in FIG. 5J. In the electrodeposition method, the electrode film 260, the first extraction electrode 261, and the second extraction electrode 262 are energized to form a polyimide insulating film on the respective electrodes. The thickness of the formed polyimide resin film is 2 μm. The electrode film 260 is separated from a side edge of the upper surface 256 of the stacked piezoelectric body 251 and 252 and a side edge of the slanting surface 255 by distances W6 and W5, respectively. Therefore, the polyimide insulating film formed by the electrodeposition method is able to cover up to the end portion of the electrode film 260 in the groove 254. Furthermore, portions outside the frame 203 are configured to prevent a polyimide insulating film by the electrodeposition method from being formed on the portions. A protective film is applied onto the second extraction electrode 262 outside the frame 203, thus preventing formation of an electrodeposited film.

Instead of the polyimide insulating film by the electrodeposition method, photosensitive polyimide can also be used.

Figure 5K:
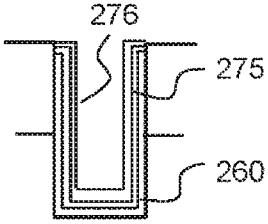

A second insulating film 276 is formed on the first insulating film 275 as illustrated in FIG. 5K. The second insulating film 276 is made of a paraxylene-based polymer. The paraxylene-based polymer is deposited as a film by chemical vapor deposition (CVD). The thickness of the second insulating film 276 is set to 3 μm. The thickness of the second insulating film 276 available for deposition is in the range of 2 μm to 10 μm. The paraxylene-based polymer has high uniformity of the film thickness and is, therefore, effective. The first insulating film 275 and the second insulating film 276 prevent the electrode film 260, the first extraction electrode 261, and the second extraction electrode 262 from contacting ink. Thus, in the an inkjet head for ejecting aqueous ink, the first and second insulating films 275 and 276 protect the electrode film 260 and prevent electrolysis of aqueous ink.

Specific examples of the possible paraxylene-based polymers include "parylene C" (poly-chloroparaxylene), "parylene D" (poly-dichloroparaxylene), and "parylene N" (poly-paraxylene).

As illustrated in FIG. 4, one groove 254 is surrounded by two stacked piezoelectric bodies 251 and 252 and the nozzle plate 204. The nozzle plate 204 is affixed by epoxy bonding agent to the upper surface 256 of the stacked piezoelectric body 251 and 252 and the frame 203 in such a manner that the nozzle 240 is located at the center of both the length W2 of the upper surface 256 of the stacked piezoelectric body 251 and 252 and the width W3 of the groove 254. A space surrounded by two stacked piezoelectric bodies 251 and 252 and the nozzle plate 204 functions as a pressure chamber 221 or 231 which causes pressure in ink.

FIGS. 5A, 5B, 5C, 5D, 5E, 5F, 5G, 5H, 5I, 5J, and 5K illustrate a process for manufacturing the first piezoelectric actuator row 220. FIG. 5A illustrates the stacked piezoelectric body 251 and 252 fixed onto the substrate 202. The stacked piezoelectric body 251 and 252 has a width of 3.5 mm, a length of 52 mm, and a thickness of 1 mm. The first piezoelectric body 251 and the second piezoelectric body 252 are polarized in opposite directions. FIG. 5B illustrates formation of the slant surface 255 by a diamond blade 270. The slant surface 255 with an angle of 45° is formed at both ends of the stacked piezoelectric body 251 and 252 in the X-axis direction. Since the slant surface 255 with an angle of 45° is formed at both ends, the cross-section of the stacked piezoelectric body 251 and 252 is a trapezoid. The angle of the slant surface 255 can be set to angles other than 45° as long as the electrode film 260 in the groove 254, the first extraction electrode 261, and the second extraction electrode 262 can be electrically connected to each other. FIG. 5C illustrates processing of the groove 254 by a diamond blade 271. A plurality of grooves 254 extending in the X-axis direction is formed. FIG. 5D illustrates a first piezoelectric actuator row 220 with the grooves 254 processed. The second piezoelectric actuator row 230 is also processed in a similar manner.

Processing of the groove 254 as viewed from the direction B-B illustrated in FIG. 5D is described with reference to FIGS. 5E to 5K. FIG. 5E illustrates the inside of the groove 254 before formation of electrodes. FIG. 5F illustrates a nickel-gold (Ni—Au) film formed on the inner surface of the groove 254, the upper surface 256 of the second piezoelectric body 252, the slant surface 255, and the upper surface of the substrate 202. The nickel-gold film is formed with a thickness of 2 μm by the electroless plating process. FIG. 5G illustrates photo-etching of the nickel-gold film. Photo sensitive resist is applied to the inside of the groove 254, the upper surface 256, the slant surface 255, and the upper surface of the substrate 202. Ultraviolet exposure 277 is performed with use of a mask 273. The mask 273 has a pattern formed therein used to form the electrode 260 and the first and second extraction electrodes 261 and 262. The mask has a flat surface but is excellent in straightness of the exposure 277, so that a high-definition photo sensitive resist pattern 272 can be formed on the slant surface 255, the upper surface 256, and the upper surface of the substrate 202. The photo sensitive resist pattern 272 is formed with a width W7 on the slant surface 255 of the groove 254 and the upper surface 256 of the second piezoelectric body 252. FIG. 5H illustrates etching of the nickel-gold film. If the etching time used for etching the nickel-gold film is long, a portion 274 of the nickel-gold film below the photo sensitive resist pattern 272 is etched. When what is referred to as over-etching is performed, the electrode film 260 in the groove 254 is formed to extend to a position separated from a side of the slant surface 255 by a distance W5. FIG. 5I illustrates the electrode 260 which is separated from the side of the slant surface 255 by the distance W5 after the photo sensitive resist pattern 272 is removed. FIG. 5J illustrates a polyimide insulating film 275, also referred to as a first insulating film, formed on the electrode film 260 by the electrodeposition method. FIG. 5K illustrates a paraxylene-based polymer 276 formed on the polyimide insulating film 275. With this formation process, the first piezoelectric actuator row 220 and the second piezoelectric actuator row 230 are formed.

The circuit module 300 generates electrical signals to drive the piezoelectric actuator 251 and 252. As illustrated in FIG. 2A, the circuit module 300 is configured with a flexible wiring board, also referred to as a flexible printed circuit (FPC), on which a drive integrated circuit (IC) 303 is mounted, and a circuit board, which converts a signal input from outside the inkjet head 1 into a signal to be input to the drive IC 303. The circuit module 300 is configured to receive a signal from outside the inkjet head 1 via a connector 305. A wiring pattern for interconnecting the second extraction electrode 262, which is connected to the piezoelectric actuator 251 and 252, and the drive IC 303 is formed on the FPC. The second extraction electrode 262 and the wiring pattern of the FPC are connected to each other by an anisotropic contact film (ACF) 302.

Figure 6A:
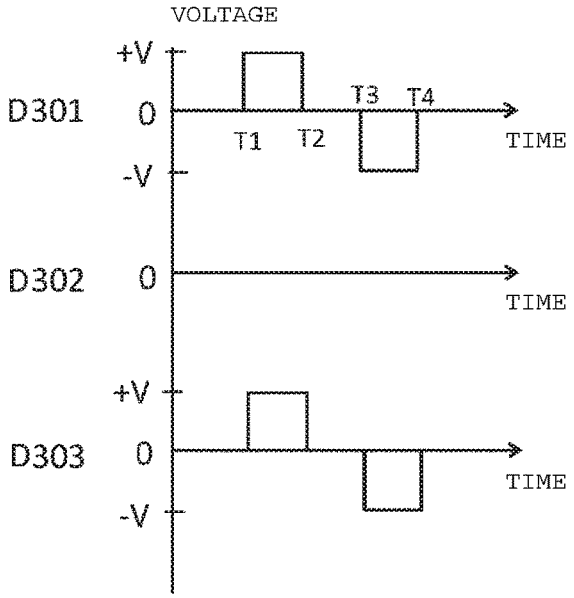
FIGS. 6A, 6B, 6C, 6D, and 6E are diagrams of a method for driving an inkjet head according to the first embodiment.
Figure 6B:
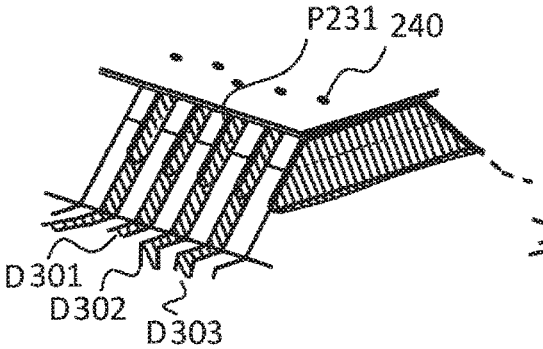

FIG. 6A illustrates signals for driving the ink ejection portion 200, which are generated by the circuit module 300. Moreover, FIGS. 6B, 6C, 6D, and 6E illustrate states of the pressure chambers 231. An example in which an ink droplet 241 is ejected from a pressure chamber P231 is described. As illustrated in FIG. 6B, a drive signal D301 is sent to the second extraction electrode 262 connected to a pressure chamber 231 which is adjacent to the pressure chamber P231. A drive signal D302 is sent to the second extraction electrode 262 connected to the pressure chamber P231, which is intended to eject ink. A drive signal D303 is sent to the second extraction electrode 262 connected to another pressure chamber 231 which is also adjacent to the pressure chamber P231.

Figure 6C:
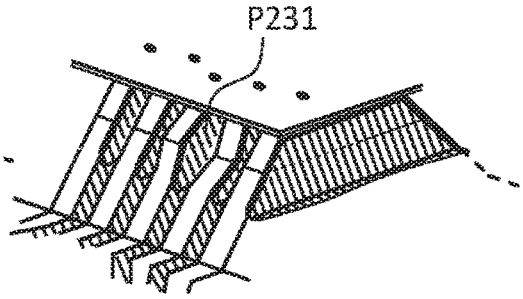
Figure 6D:
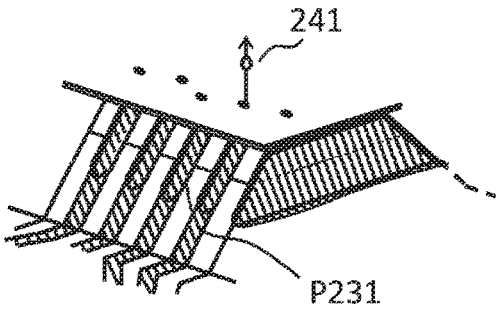
Figure 6E:
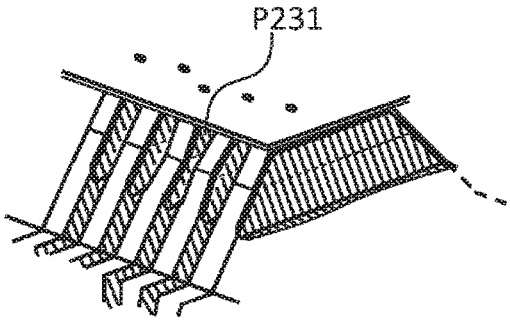

The drive signals D301 and D303 have the same wavelength. The drive signal D302 is at ground potential. The drive signals D301 and D303 are at 0 voltage from time 0 until time T1 and rise to +V voltage at time T1. A change in the volume of the pressure chamber P231 does not occur before time T1. When the drive signals D301 and D303 rise to +V voltage at time T1, the piezoelectric actuator 251 and 252 makes bending deformation around an adhesion layer 253. This deformation occurs because the PZT is shear-deformed by a voltage application perpendicular to the polarization direction of the PZT. As illustrated in FIG. 6C, since two piezoelectric actuators 251 and 252 adjacent to the pressure chamber P231 make bending deformation, the capacity of the pressure chamber P231 expands. During the expanding state from time T1 until time T2, the amount of ink contained in the pressure chamber P231 increases. When the drive signals D301 and D303 return to 0 voltage at time T2, the capacity of the pressure chamber P231 returns. At this time, the pressure in the pressure chamber P231 rises as illustrated in FIG. 6D, and thus an ink droplet 241 is ejected from the nozzle 240. During a period from time T3 to time T4, the drive signals D301 and D303 apply −V voltage. At this time, as illustrated in FIG. 6E, the capacity of the pressure chamber P231 reduces. The reduction of the capacity suppresses residual vibration in the pressure chamber P231. At time T4, the drive signals D301 and D303 return to 0 voltage, thus entering a waiting state.

In the first embodiment, an inkjet head includes a substrate, a nozzle plate having nozzles configured to eject ink, a piezoelectric body provided between the substrate and the nozzle plate and having a slant surface and a plurality of grooves traversing the slant surface, a conductive film formed on an inner surface of each of the grooves of the piezoelectric body while being separated from a top portion of the piezoelectric body and the slant surface, and an insulating film covering the conductive film. Thus, no conductive film is formed near a right-angle portion formed in the piezoelectric body.

Figure 7:
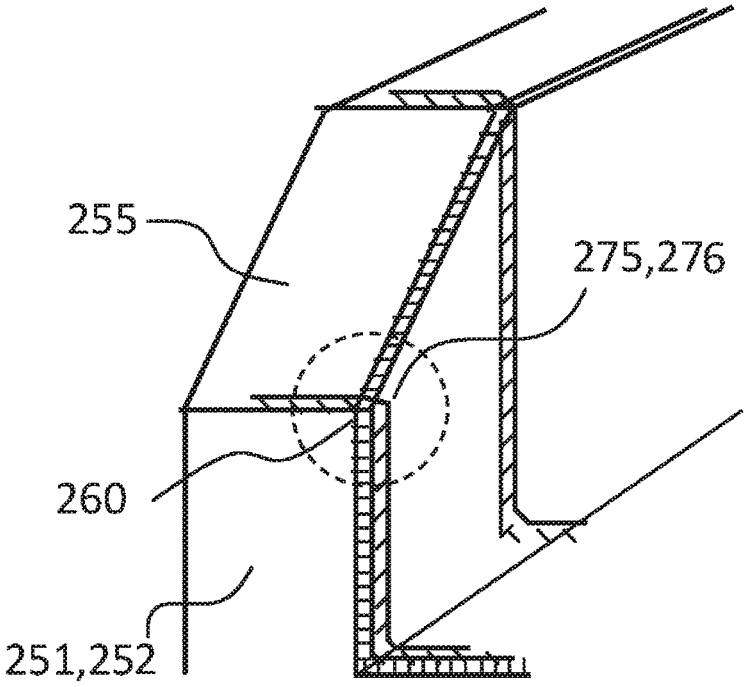
FIG. 7 is a diagram of a protective film serving as a reference example.

The right-angle portion occurs because the grooves 254 are formed in the stacked piezoelectric body 251 and 252. As illustrated in FIG. 7, the protective film 275 or 276 is apt to become thin near the right-angle portion. Moreover, at the right-angle portion, a minute defect as a pinhole is likely to be formed in the protective film 275 or 276. If the electrode film 260 is formed to extend to the end portion or side edge of the slant surface 255 or the second piezoelectric body upper surface 256, thickness of the protective film may decrease or a pinhole may be formed. If a decrease in thickness or a pinhole occurs, the electrode film 260 may contact ink. In a case where ink is aqueous, the ink has electrical conductivity. If the conductive ink contacts an electrode, the electrolysis of the ink occurs due to electrical signals for activating the piezoelectric actuator 251 and 252. The electrolysis deteriorates the ink. Moreover, since current flows through the ink, it becomes difficult to activate the piezoelectric actuator 251 and 252, and thus ink ejection failure occurs.

In the inkjet head 1 according to the first embodiment, the electrode film 260 is formed while being separated from a top portion of the piezoelectric actuator 251 and 252 and a side of the slant surface. Therefore, the protective films 275 and 276 are able to sufficiently cover the electrode film 260. Since the protective films 275 and 276 insulate the electrode film 260 from ink, the electrolysis of ink or an operation failure of the piezoelectric actuator 251 and 252 can be reduced.

Second Embodiment

A second embodiment is similar to the first embodiment in the configuration of the inkjet head 1. A difference between them is a method for forming the electrode film 260.

Figure 8A:
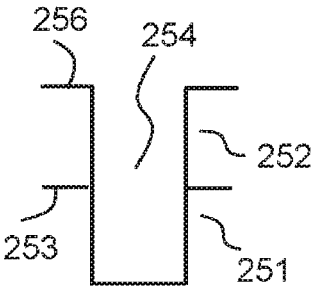
FIGS. 8A, 8B, 8C, 8D, 8E, 8F, and 8G are diagrams of a method for manufacturing an inkjet head according to a second embodiment.
Figure 8B:
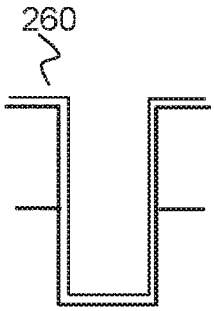
Figure 8C:
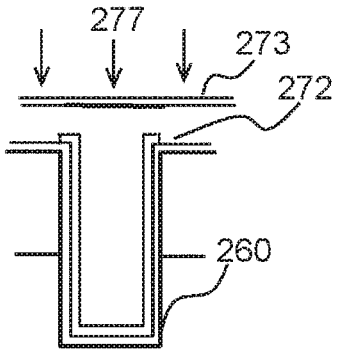
Figure 8D:
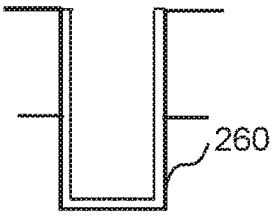
Figure 8E:
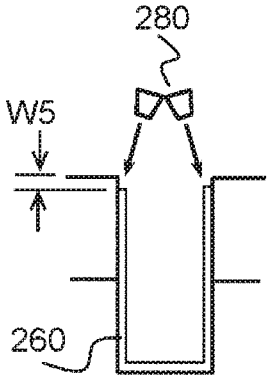
Figure 8F:
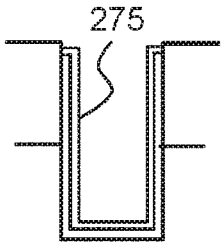
Figure 8G:
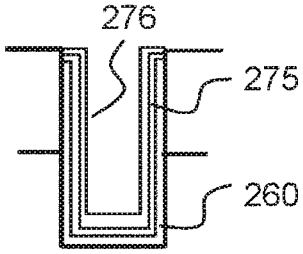

A process for forming the electrode film 260 in the groove 254 is described with reference to FIGS. 8A, 8B, 8C, 8D, 8E, 8F, and 8G. FIG. 8A illustrates the inside of the groove 254 before formation of electrodes. FIG. 8B illustrates a nickel-gold (Ni—Au) film formed on the inner surface of the groove 254, the upper surface 256 of the second piezoelectric body 252, the slant surface 255, and the upper surface of the substrate 202. The nickel-gold film is formed with a thickness of 2 μm by the electroless plating process. FIG. 8C illustrates photo-etching of the nickel-gold film. Photo sensitive resist is applied to the inside of the groove 254, the upper surface 256, the slant surface 255, and the upper surface of the substrate 202. Ultraviolet exposure 277 is performed with use of a mask 273. The mask 273 has a pattern formed therein used to form the electrode 260 and the first and second extraction electrodes 261 and 262. FIG. 8D illustrates the electrode film 260 in the groove 254 after etching of the nickel-gold film is completed and the photo sensitive resist pattern is removed. FIG. 8E illustrates a process of removing a part of the nickel-gold electrode film 260 formed near a side of the second piezoelectric body 252 and a side of the slant surface 255 with use of a laser 280. An excimer laser is operated to perform scanning in conformity with the shapes of the side of the second piezoelectric body 252 and the side of the slant surface 255, thus sublimating the electrode film 260. The electrode film 260 in the groove 254 is formed to extend to a position separated from the side edge of the slant surface 255 by the distance W5. FIG. 8F illustrates a polyimide insulating film 275, also referred to as a first insulating film, formed on the electrode film 260 by the electrodeposition method. FIG. 8G illustrates a paraxylene-based polymer 276 formed on the polyimide insulating film 275. With this formation process, the first piezoelectric actuator row 220 and the second piezoelectric actuator row 230 are formed.

In the second embodiment, the electrode film 260 is also formed while being separated from the top portion of the piezoelectric actuator 251 and 252 and the side of the slant surface. Therefore, the protective films 275 and 276 are able to sufficiently cover the electrode film 260. Since the protective films 275 and 276 insulate the electrode film 260 from ink, the electrolysis of ink or an operational failure of the piezoelectric actuator 251 and 252 can be reduced. Since apart of the electrode film 260 is removed by laser processing, processing can be performed while measuring the amount of removal in the electrode film 260. Therefore, the amount of removal in the electrode film 260 can be made as small as possible. As the amount of removal is smaller, the area of the electrode film 260 becomes larger, and thus the amount of deformation of the piezoelectric actuator 251 and 252 can be made larger. As a result, the amount of ejection of ink can be increased.

As described above, the inkjet printer 100 can have the following general configuration: 1) an inkjet head including: a substrate; a nozzle plate having nozzles configured to eject ink; a piezoelectric body provided between the substrate and the nozzle plate and including a first surface having a first width in a first direction, a second surface opposite to the first surface and having a second width greater than the first width in the first direction, a slant surface extending from a side of the first surface to a side of the second surface, and a plurality of grooves formed in the first direction and traversing the slant surface; a conductive film formed on an inner surface of each of the plurality of grooves of the piezoelectric body while being separate from the first surface and the slant surface; and an insulating film covering the conductive film; 2) an ink circulation device configured to supply ink to the inkjet heads, to collect ink not ejected from the nozzle through the groove, and to re-supply ink to the inkjet head; and 3) a conveyance device configured to convey a recording medium on which an image is formed by the inkjet head.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A method for manufacturing an inkjet head, the method comprising:

attaching a piezoelectric body having a first surface and a second surface opposite to the first surface to a substrate, the second surface facing the substrate;

forming slanting side surfaces on the piezoelectric body, the slanting side surfaces extending between the first surface and the second surface such that first surface has a remaining area that is less than a remaining area of second surface;

forming a groove in the piezoelectric body from the first surface towards the second surface, the groove passing through the slanting side surfaces on opposite sides of the piezoelectric body;

forming a conductive film on an inner surface of the groove;

trimming portions of the conductive film proximate to the first surface and the slanting side surfaces such that the conductive film is separated from the first surface and the slanting side surfaces at outer edges of the groove; and forming an insulating film over the conductive film.

2. The method according to claim 1, further comprising:

forming a first extraction electrode on one of the slanting side surfaces of the piezoelectric body; and forming a second extraction electrode on the substrate, wherein the first extraction electrode and the second extraction electrode are connected to the trimmed conductive film.

3. The method according to claim 1, wherein the piezoelectric body comprises a stack of a first piezoelectric layer and a second piezoelectric layer, which are polarized in opposite directions to each other along a thickness of the piezoelectric body.

4. The method according to claim 1, wherein trimming the portions of the conductive film comprises:

applying photo-sensitive resist to the conductive film on the inner surface of the groove, and the first surface and the slanting side surfaces of the piezoelectric body;

patterning the photo-sensitive resist with light through a mask to form a resist pattern covering inner walls of the groove;

etching the conductive film exposed by the resist pattern and over-etching the conductive film to remove a part of the conductive film covered by the resist pattern; and removing the photo-sensitive resist.

5. The method according to claim 1, wherein trimming the portions of the conductive film comprises:

applying photo-sensitive resist to the conductive film on the inner surface of the groove, and the first surface and the slanting side surfaces of the piezoelectric body;

patterning the photo-sensitive resist with light through a mask to form a resist pattern covering inner walls of the groove;

etching the conductive film exposed by the resist pattern;

removing the photo-sensitive resist; and scanning an excimer laser over a part of the conductive film that is proximate to the first surface and the slanting side surfaces of piezoelectric body.

6. The method according to claim 1, wherein an area of the conductive film after the end portions trimmed is in a range of 90% to 99% of an area of a side inner wall of the groove.

7. The method according to claim 2, wherein forming the conductive film comprises:

forming a first insulating layer made of polyimide resin on the trimmed conductive film, the first extraction electrode, and the second extraction electrode; and forming a second insulating layer made of a paraxylene-based polymer.

8. A method for manufacturing an inkjet head, the method comprising:

attaching a piezoelectric body having a first surface and a second surface opposite to the first surface to a substrate, the second surface facing the substrate;

forming slanting side surfaces on the piezoelectric body, the slanting side surfaces extending between the first surface and the second surface such that first surface has a remaining area that is less that a remaining area of second surface;

forming a groove in the piezoelectric body from the first surface towards the second surface, the groove passing through two slanting side surfaces on opposite sides of the piezoelectric body;

forming a conductive film on an inner surface of the groove;

trimming portions of the conductive film proximate to the first surface and the slanting side surfaces such that the conductive film is separated from the first surface and the slanting side surfaces at outer edges of the groove;

forming a first extraction electrode on one of the slanting side surfaces of the piezoelectric body, the first extraction electrode being connected to the trimmed conductive film; and forming a second extraction electrode on the substrate, the second extraction electrode being connected to the trimmed conductive film;

forming a first insulating film on the conductive film, the first extraction electrode, and the second extraction electrode; and forming a second insulating film on the conductive film.

9. The method according to claim 8, wherein the piezoelectric body comprises a stack of a first piezoelectric layer and a second piezoelectric layer, which are polarized in opposite directions to each other along a thickness of the piezoelectric body.

10. The method according to claim 8, wherein trimming the portions of the conductive film comprises:

applying photo-sensitive resist to the conductive film on the inner surface of the groove, and the first surface and the slanting side surfaces of the piezoelectric body;

patterning the photo-sensitive resist with light through a mask to form a resist pattern covering inner walls of the groove;

etching the conductive film exposed by the resist pattern and over-etching the conductive film to remove a part of the conductive film covered by the resist pattern; and removing the photo-sensitive resist.

11. The method according to claim 8, wherein trimming the portions of the conductive film comprises:

applying photo-sensitive resist to the conductive film on the inner surface of the groove, and the first surface and the slanting side surfaces of the piezoelectric body;

patterning the photo-sensitive resist with light through a mask to form a resist pattern covering inner walls of the groove;

etching the conductive film exposed by the resist pattern;

removing the photo-sensitive resist; and scanning an excimer laser over a part of the conductive film that is proximate to the first surface and the slanting side surfaces of piezoelectric body.

12. The method according to claim 8, wherein an area of the conductive film after the end portions trimmed is in a range of 90% to 99% of an area of a side inner wall of the groove.

13. The method according to claim 8, wherein the first insulating film is made of polyimide resin and formed by an electrodeposition method, and the second insulating film is made of a paraxylene-based polymer by chemical vapor deposition.

14. The method according to claim 8, wherein the first insulating film is made of photosensitive polyimide by an electrodeposition method, and the second insulating film is made of a paraxylene-based polymer by chemical vapor deposition.

15. An inkjet head, comprising:

a substrate;

a nozzle plate having a plurality of nozzles from which ink can be ejected;

a piezoelectric body provided between the substrate and the nozzle plate, the piezoelectric body having slanting side surfaces extending from a nozzle plate side surface to a substrate side surface of the piezoelectric body, and having a width on the nozzle plate side surface that is less than a width on the substrate side surface;

a plurality of grooves in the piezoelectric body extending from the nozzle plate side surface towards the substrate side surface, each groove in the plurality passing through two slanting side surfaces and being associated with a nozzle in the plurality of nozzles;

a conductive film on an inner surface of each of the plurality of grooves of the piezoelectric body, the conductive film being spaced from the nozzle plate side surface and the slanting side surfaces at outer edges of the groove; and an insulating film covering the conductive film.

16. The inkjet head according to claim 15, further comprising:

a first extraction electrode on one of the slanting side surfaces of the piezoelectric body; and a second extraction electrode on the substrate, wherein the first extraction electrode and the second extraction electrode are connected to the conductive film.

17. The inkjet head according to claim 15, wherein the piezoelectric body comprises a stack of a first piezoelectric layer and a second piezoelectric layer, which are polarized in opposite directions to each other along a thickness of the piezoelectric body.

18. The inkjet head according to claim 15, wherein an area of the conductive film is in a range of 90% to 99% of an area of a side inner wall of the groove.

19. The inkjet head according to claim 15, wherein the insulating film comprises a plurality of insulating layers.

20. The inkjet head according to claim 19, wherein the plurality of insulating layers includes:

a first insulating layer made of polyimide resin on the conductive film, the first extraction electrode, and the second extraction electrode; and a second insulating layer made of a paraxylene-based polymer.

* * * * *